US006350019B1

(12) United States Patent
Shingai et al.

(10) Patent No.: US 6,350,019 B1
(45) Date of Patent: Feb. 26, 2002

(54) INK JET HEAD AND INK JET PRINTER

(75) Inventors: Tomohisa Shingai; Koichi Oikawa; Shuji Koike; Yoshiaki Sakamoto, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/531,441

(22) Filed: Mar. 20, 2000

(30) Foreign Application Priority Data

Jul. 15, 1999 (JP) ..... 11-201640

(51) Int. Cl.[7] ..... B41J 2/045
(52) U.S. Cl. ..... 347/70
(58) Field of Search ..... 347/68–70; 310/330, 310/331, 332

(56) References Cited

U.S. PATENT DOCUMENTS

| | | | | |
|---|---|---|---|---|
| 5,265,315 A | | 11/1993 | Hoisington et al. | 29/25.35 |
| 5,689,291 A | * | 11/1997 | Tence et al. | 347/10 |
| 6,137,511 A | * | 10/2000 | Furuhata et al. | 347/70 |

FOREIGN PATENT DOCUMENTS

| | | |
|---|---|---|
| EP | 0 884 184 A1 | 12/1998 |
| GB | 2 088 287 A | 6/1982 |
| GB | 2 104 006 A | 3/1983 |
| JP | 51-47213 | 6/1993 |
| JP | 10-209517 | 8/1998 |

OTHER PUBLICATIONS

Office Action of corresponding German patent application with translation.

* cited by examiner

*Primary Examiner*—John Barlow
*Assistant Examiner*—Michael S Brooke
(74) *Attorney, Agent, or Firm*—Armstrong, Westerman, Hattori, McLeland & Naughton, LLP

(57) ABSTRACT

An ink jet head includes a pressure chamber, a vibration plate, and a piezoelectric element which is provided on the vibration plate and causes a volume displacement of the pressure chamber. The piezoelectric element has a thickness of 20 $\mu$m or less, and the pressure chamber and the piezoelectric element satisfy a relation $\mathbf{V0}/(\mathbf{L2}^2 b) > 550 \times 10^{-6}$, where V0 [$m^3$] denotes a volume displacement of the pressure chamber when the piezoelectric element is driven, L2 [m] denotes a width of the piezoelectric element, and b [m] denotes a depth of the pressure chamber.

14 Claims, 9 Drawing Sheets

FIG.9

| | $L_1$ ($\times 10^{-6}$m) | b ($\times 10^{-6}$m) | $h_1$ ($\times 10^{-6}$m) | $h_2$ ($\times 10^{-6}$m) | $L_2$ ($\times 10^{-6}$m) | E ($\times 10^{9}$Pa) | $V_0$ ($\times 10^{-15}$m$^3$) | $\frac{V_0}{L_2^2 b}$ ($\times 10^{-6}$) | $\frac{EV_0}{L_2^2 b}$ ($\times 10^{6}$) | $\frac{V}{h_2}$ ($\times 10^{6}$) | (dpi) | | |
|---|---|---|---|---|---|---|---|---|---|---|---|---|---|
| EX1 | 2000 | 2000 | 100 | 150 | 1800 | 65 | 160 | 24.7 | 1.61 | 0.8 | 10 | 0.5 | — |
| EX2 | 600 | 4000 | 100 | 100 | 540 | 65 | 120 | 103 | 6.7 | 0.8 | 30 | 0.7 | — |
| EX3 | 330 | 2150 | 10 | 20 | 300 | 55 | 53 | 274 | 15.1 | 1.25 | 60 | 1 | — |
| CX1 | 330 | 2150 | 10 | 20 | 300 | 90 | 18 | 83.9 | 7.55 | 1.25 | 60 | 0.3 | × |
| CX2 | 330 | 2150 | 10 | 20 | 300 | 90 | 37 | 191 | 17.2 | 2.6 | 60 | 0.7 | × |
| EMB1 | 330 | 2150 | 10 | 20 | 300 | 90 | 216 | 1117 | 100.5 | 15.2 | 60 | 4.1 | ○ |
| EMB2 | 100 | 1700 | 2 | 3 | 80 | 90 | 9 | 827 | 74.4 | 3.33 | 150 | 1 | △ |
| EMB3 | 100 | 1700 | 2 | 3 | 80 | 90 | 22 | 2022 | 182 | 8.33 | 150 | 1.7 | ○ |
| EMB4 | 100 | 1700 | 2 | 3 | 80 | 90 | 53 | 4870 | 438.3 | 19.3 | 150 | 4.2 | ○ |
| EMB5 | 56 | 196 | 1.2 | 2.4 | 45 | 90 | 1.5 | 3779 | 340.1 | 5.36 | 300 | 1.8 | ○ |
| EMB6 | 56 | 196 | 1.2 | 2.4 | 45 | 90 | 3.5 | 8818 | 793.6 | 12.5 | 300 | 4.3 | ○ |

INK JET HEAD AND INK JET PRINTER

BACKGROUND OF THE INVENTION

1. Field of the Invention

The present invention generally relates to ink jet heads and ink jet printers, and more particularly to an ink jet head which uses a thin film piezoelectric element as a means of jetting ink, and to an ink jet printer which uses such an ink jet head.

Most inexpensive color printers are ink jet printers which use the ink jet head, because ink jet head does not generate noise and the ink jet printer can realize color printing at a low cost compared to electrophotography printers.

Recently, there are demands to realize a high resolution by the ink jet printer, and rapid developments are being made to minimize the drop diameter of the ink which is jetted from the ink jet head. Moreover, there are demands to realize an ink jet printer having a structure suited for mass production, while satisfying the demands to realize a high performance.

2. Description of the Related Art

FIG. 1 is a diagram showing an example of an ink jet printer. An ink jet printer 10 shown in FIG. 1 includes an ink jet head 11 which is mounted on a lower surface of a carriage 12. This ink jet head 11 is positioned between a feed roller 13 and an eject roller 14, and confronts a platen 15. The carriage 12 has an ink tank 16, and is movable in a direction perpendicular to a drawing paper on which FIG. 1 is drawn.

A paper 17 is pinched between a pinch roller 18 and the feed roller 13, and is transported in a direction A in a state pinched between a pinch roller 19 and the eject roller 14. The ink jet head 11 prints on the paper 17 when the ink jet head 11 operates and the carriage 12 moves in the direction perpendicular to the drawing paper. After the printing, the paper 17 is accommodated within a stacker 20.

FIG. 2 is a perspective view showing an important part of an ink jet head. As shown in FIG. 2, an ink jet head 30, which corresponds to the ink jet head 11 described above, includes a nozzle plate 33 formed with nozzles 32 from which ink is jetted, pressure chambers 35 and ink passages 40 which are respectively formed in correspondence with each of the nozzles 32, a driving part 31 forming one wall of each of the pressure chambers 35, a common ink passage 39 for supplying the ink to each of the pressure chambers 35, and a main body 36. The pressure chambers 35 and the common ink passage 39 are integrally formed in the main body 36.

The driving part 31 includes piezoelectric elements 37 which are provided with respect to each of the pressure chambers 35 on a vibration plate 34 which forms one wall of each of the pressure chambers 35 in common. The vibration plate 34 also forms the common electrode of each piezoelectric element 37. Individual electrodes 38 are provided on the top surface of the corresponding piezoelectric elements 37. The driving part 31 forms a bimorph structure by the piezoelectric elements 37 and the vibration plate 34. When a driving signal from a controller is applied on the individual electrode 38, the corresponding piezoelectric element 37 is distorted so as to contract in an in-plane direction of the vibration plate 34. Hence, the driving part 31 deforms towards the corresponding pressure chamber 35 as indicated by a phantom line in FIG. 2, and the ink drop is jetted from the corresponding nozzle 32. When the driving signal is no longer applied to the individual electrode 38, the driving part 31 is restored to the flat non-deformed state, thereby supplying the ink from the common ink passage 39 to the corresponding ink chamber 35.

According to such a bimorph structure, it is possible to obtain a large volume displacement with respect to a small distortion of the piezoelectric element without requiring complex structure for fixing piezoelectric element end. For this reason, this bimorph structure is suited for mass production.

When forming the bimorph structure, a plate-shaped piezoelectric element base is cut into a plurality of narrow piezoelectric elements, and the piezoelectric elements are fixed on the vibration plate by means of an adhesive agent or the like. But because of this structure, the piezoelectric element may come off from the vibration plate when the piezoelectric element is greatly deformed, and there is a problem in that it is difficult to form an ink jet head having a satisfactory printing efficiency. Furthermore, since it is necessary to carry out a process of fixing the mechanically cut piezoelectric elements on the vibration plate, it is difficult to miniaturize the pressure chambers and the piezoelectric elements.

On the other hand, a relatively small bimorph structure can be made by forming the piezoelectric elements by use of the printing technique. In other words, a common electrode is formed on a vibration plate which is made of a highly heat resistant material such as ceramics, and a paste of the material which forms the piezoelectric elements is formed and patterned on the vibration plate by use of the screen printing technique, and then baked. It is difficult to increase the density of the piezoelectric elements having this structure because the piezoelectric elements are formed by use of the printing technique, and in addition, the piezoelectric elements formed are brittle mechanically and electrically. As a result, there is a problem in that the piezoelectric element breaks when the piezoelectric element is greatly deformed. Consequently, it is necessary to increase the area of the pressure chambers and the piezoelectric elements as much as possible, in order to compensate for the small tolerable deformation of the piezoelectric elements.

However, according to the method which forms the bimorph structure using the printing technique, it is difficult to mass produce the piezoelectric elements having a thickness of less than 15 $\mu$m. For this reason, the pressure chamber must have a width of at least 200 $\mu$m in order to mass produce the ink jet heads having a satisfactory printing efficiency, and the pitch of the nozzles cannot be made small.

On the other hand, in order to make the piezoelectric element thin, it is possible to use the thin film technique such as sputtering, instead of using the screen printing technique. But when the thin film technique is used, the thickness of the piezoelectric element on the order of several tens of $\mu$m is too thick for mass production, in that it takes too much time to form such a thick layer by the thin film technique. Hence, if an attempt is made to use a piezoelectric element having a thickness on the order of only several $\mu$m which can be formed by the thin film technique, it is impossible to generate a sufficiently large pressure with respect to the ink due to the bimorph structure if the size of the pressure chamber is the same as that for the thick piezoelectric element having the thickness of less than 15 $\mu$m. As a result, it is impossible to obtain a sufficiently large volume displacement by use of such a thin piezoelectric element.

Furthermore, if the size of the pressure chamber with respect to the thin piezoelectric element is reduced to the same proportion as the size of the pressure chamber with respect to the thick piezoelectric element, the pressure chamber becomes too small. Consequently, the ink drop which can be jetted by the combination of the thin piezoelectric element and the small pressure chamber becomes extremely small, that is, only on the order of a fraction of 1 pl or less, where 1 pl=$10^{-12}$ 1=$10^{-15}$ $m^3$.

It is possible to arrange the nozzles at a small pitch when the pressure chamber is small, and a high-quality image can be printed when the ink drop is small, thereby making it possible to realize a high-performance ink jet head. However, the ink drop must be at least 2 pl in order for a corresponding printed dot to be recognizable by the human eyes, and for this reason, the image quality cannot be improved even if the printing is carried out using ink drops smaller than 2 pl.

In addition, various problems are introduced when an attempt is made to print by use of the combination of the thin piezoelectric element and the small pressure chamber which jets ink drops on the order of a fraction of 1 pl, for example. First, the nozzles must be made small in order to produce the small ink drops, but such small nozzles easily clog. When nozzles are clogged, it is essential to remove the clog by use of a backup unit. Second, when the ink drop is small, the ink drop jetted from the nozzle is greatly affected by air friction before reaching the paper surface, and the accuracy of the landing position of the ink drop deteriorates. Third, in order to obtain a required printing density, the amount of dye or coloring material required per unit area is approximately the same regardless of the size of the ink drop, and for this reason, it takes an extremely long time to carry out the printing because an extremely large number of dots must be printed by the small ink drops in order to obtain a printing density which is comparable to the conventional printing density.

Therefore, the ink jet head using the piezoelectric elements produced by the thin film technique is unsuited for realizing a high reliability. Hence, such an ink jet head is unsuited for use in a general purpose printer.

In addition, in order to eliminate the problem of the extremely long printing time, it is possible to eliminate this problem by increasing the number of nozzles. However, as the number of nozzles becomes large, the number of signal lines, the number of driver circuits which drive the piezoelectric elements, and the number of signal line connections all become large, thereby requiring a large number of production processes. Furthermore, the use of a high-performance processor becomes necessary in order to process a large amount of data, and the printer becomes too expensive from the practical point of view. Moreover, when the amount of data to be processed becomes large, a large amount of data is sent from a computer, thereby requiring a high-speed channel for transferring the printing data. As a result, it may become impossible to cope with the large amount of data and the required speed using a standard interface.

SUMMARY OF THE INVENTION

Accordingly, it is a general object of the present invention to provide a novel and useful ink jet head and ink jet printer, in which the problems described above are eliminated.

Another and more specific object of the present invention is to provide an ink jet head comprising a pressure chamber, a vibration plate, and a piezoelectric element, provided on the vibration plate, causing a volume displacement of the pressure chamber, where the piezoelectric element has a thickness of 20 $\mu$m or less, and the pressure chamber and the piezoelectric element satisfy a relation $V0/(L2^2b)>550\times10^{-6}$, where V0 [$m^3$] denotes a volume displacement of the pressure chamber when the piezoelectric element is driven, L2 [m] denotes a width of the piezoelectric element, and b [m] denotes a depth of the pressure chamber. According to the ink jet head of the present invention, it is possible to produce ink jet heads having a high printing performance with a high productivity.

Still another object of the present invention is to provide an ink jet head comprising a pressure chamber, a vibration plate, and a piezoelectric element, provided on the vibration plate, causing a volume displacement of the pressure chamber, where the piezoelectric element has a thickness of 20 $\mu$m or less, the pressure chamber and the piezoelectric element satisfy a relation $EV0/(L2^2b)>30\times10^6$, where E [Pa] denotes a Young's modulus of the piezoelectric element, V0 [$m^3$] denotes a volume displacement of the pressure chamber when the piezoelectric element is driven, L2 [m] denotes a width of the piezoelectric element, and b [m] denotes a depth of the pressure chamber. According to the ink jet head of the present invention, it is possible to produce ink jet heads having a high printing performance with a high productivity, particularly when the piezoelectric element is formed by the thin film technique and the Young's modulus E is large.

A further object of the present invention is to provide an ink jet head comprising a pressure chamber, a vibration plate, and a piezoelectric element, provided on the vibration plate, causing a volume displacement of the pressure chamber, where the piezoelectric element has a thickness of 20 $\mu$m or less, the pressure chamber and a voltage applied to the piezoelectric element satisfy a relation $V/h2>3.0\times10^6$, where V [V] denotes the voltage applied to the piezoelectric element, and h2 [m] denotes a thickness of the piezoelectric element. According to the ink jet head of the present invention, it is possible to produce ink jet heads having a high printing performance with a high productivity.

Another object of the present invention is to provide a multi-nozzle ink jet head comprising a pressure chamber connecting to a nozzle, a vibration plate which forms an upper wall surface of the pressure chamber, and a thin film piezoelectric element, provided on the vibration plate, causing a volume displacement of the pressure chamber, where the thin film piezoelectric element generates a piezoelectric effect in an in-plane direction of one surface of the vibration plate, the thin film piezoelectric element and the vibration plate have a total thickness of 10 $\mu$m or less, and the nozzle has an ink jet quantity of 1 pl or greater when the piezoelectric element is driven, and is arranged at a pitch of 150 dots/inch or greater. According to the multi-nozzle ink jet head of the present invention, it is possible to mass produce ink jet heads having a high printing efficiency.

Still another object of the present invention is to provide an ink jet printer comprising an ink jet head including a pressure chamber, a vibration plate, and a piezoelectric element which is provided on the vibration plate and causes a volume displacement of the pressure chamber, wherein the piezoelectric element has a thickness of 20 $\mu$m or less, the pressure chamber and the piezoelectric element satisfy a relation $V0/(L2^2b)>550\times10^{-6}$, where V0 [$m^3$] denotes a volume displacement of the pressure chamber when the piezoelectric element is driven, L2 [m] denotes a width of the piezoelectric element, and b [m] denotes a depth of the pressure chamber. According to the ink jet printer of the present invention, it is possible to produce ink jet printers having a high printing performance with a high productivity.

A further object of the present invention is to provide an ink jet printer comprising an ink jet head including a pressure chamber, a vibration plate, and a piezoelectric element which is provided on the vibration plate and causes a volume displacement of the pressure chamber, wherein the piezoelectric element has a thickness of 20 $\mu$m or less, the pressure chamber and the piezoelectric element satisfy a relation $EV0/(L2^2b)>30\times10^6$, where E [Pa] denotes a Young's modulus of the piezoelectric element, V0 [$m^3$] denotes a volume displacement of the pressure chamber when the piezoelectric element is driven, L2 [m] denotes a width of the piezoelectric element, and b [m] denotes a depth of the pressure chamber. According to the ink jet printer of the present invention, it is possible to produce ink jet printers having a high printing performance with a high productivity, particularly when the piezoelectric element is formed by the thin film technique and the Young's modulus E is large.

Another object of the present invention is to provide an ink jet printer comprising an ink jet head including a pressure chamber, a vibration plate, and a piezoelectric element which is provided on the vibration plate and causes a volume displacement of the pressure chamber, wherein the piezoelectric element has a thickness of 20 $\mu$m or less, the pressure chamber and a voltage applied to the piezoelectric element satisfy a relation $V/h2>3.0\times10^6$, where V [V] denotes the voltage applied to the piezoelectric element, and h2 [m] denotes a thickness of the piezoelectric element. According to the ink jet printer of the present invention, it is possible to produce ink jet printers having a high printing performance with a high productivity.

Other objects and further features of the present invention will be apparent from the following detailed description when read in conjunction with the accompanying drawings.

BRIEF DESCRIPTION OF THE DRAWINGS

FIG. 9 is a diagram for explaining performances of various ink jet heads.

DESCRIPTION OF THE PREFERRED EMBODIMENTS

Figure 1:
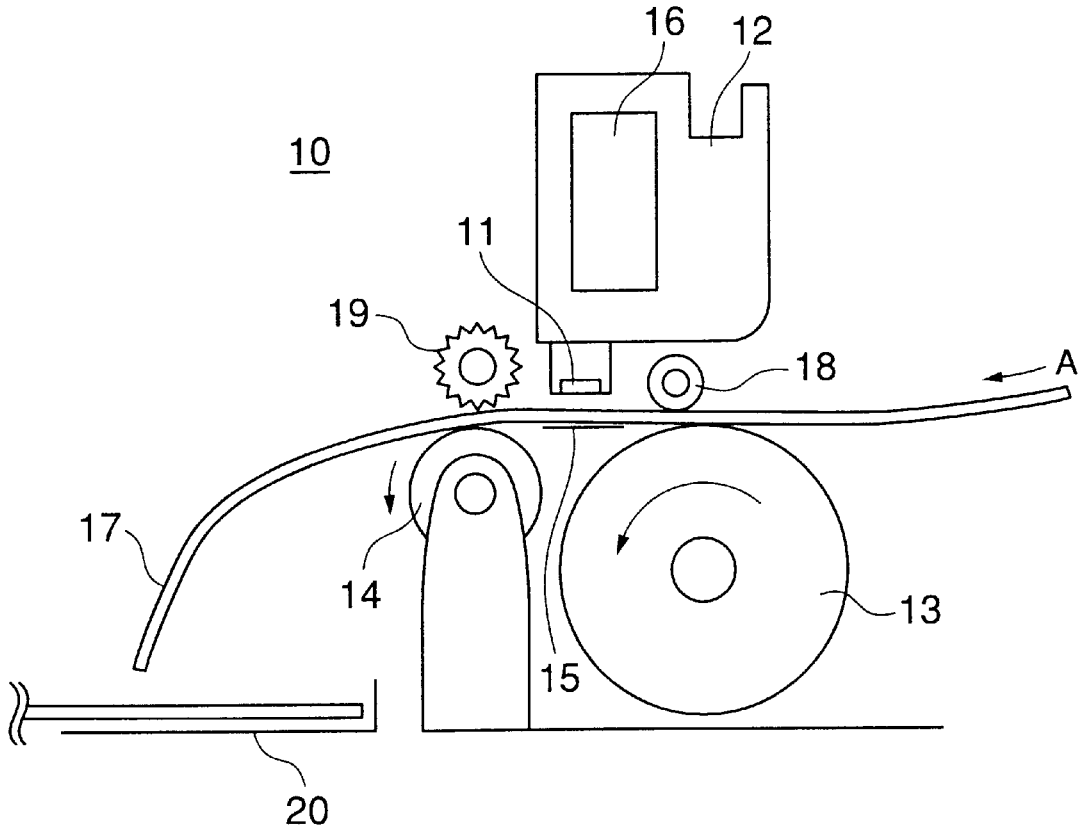
FIG. 1 is a diagram showing an example of an ink jet printer.
Figure 2:
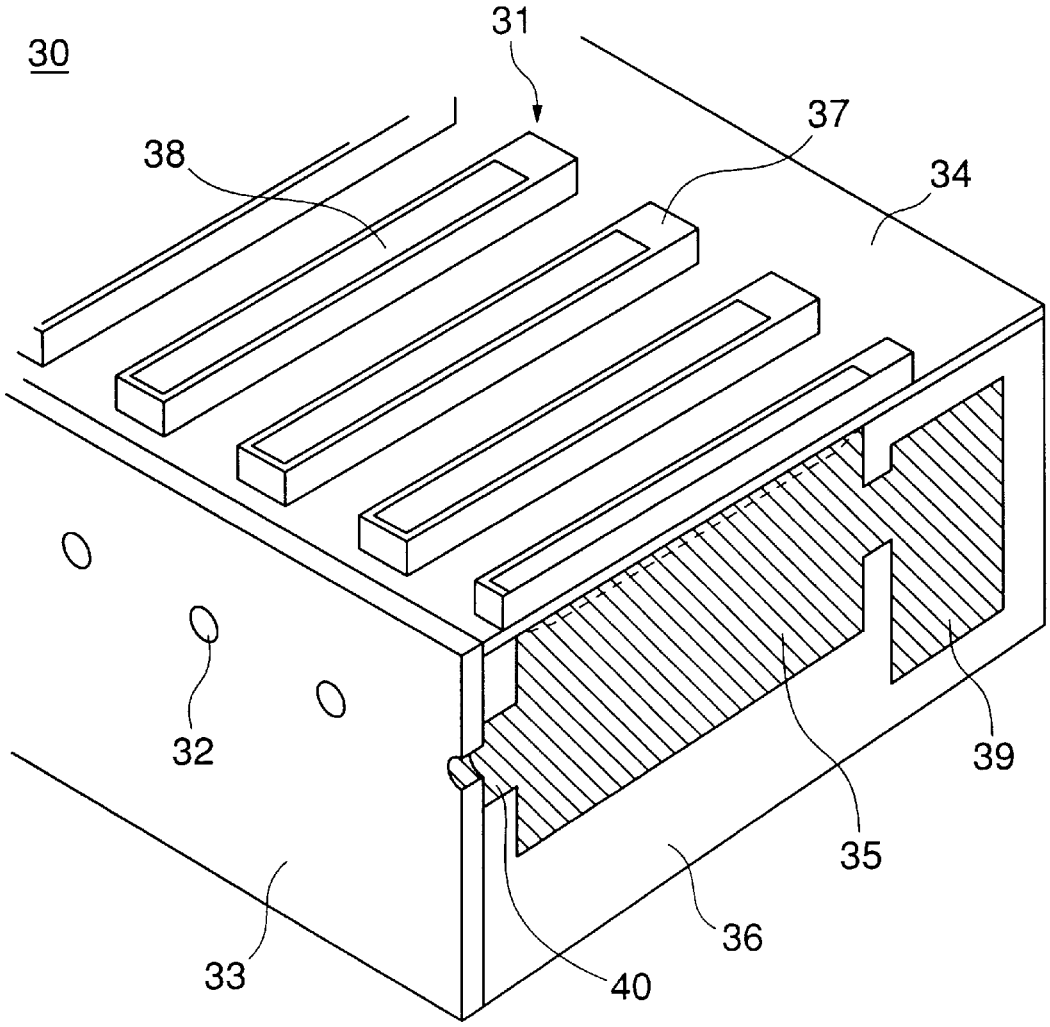
FIG. 2 is a perspective view showing an important part of an ink jet head.
Figure 3:
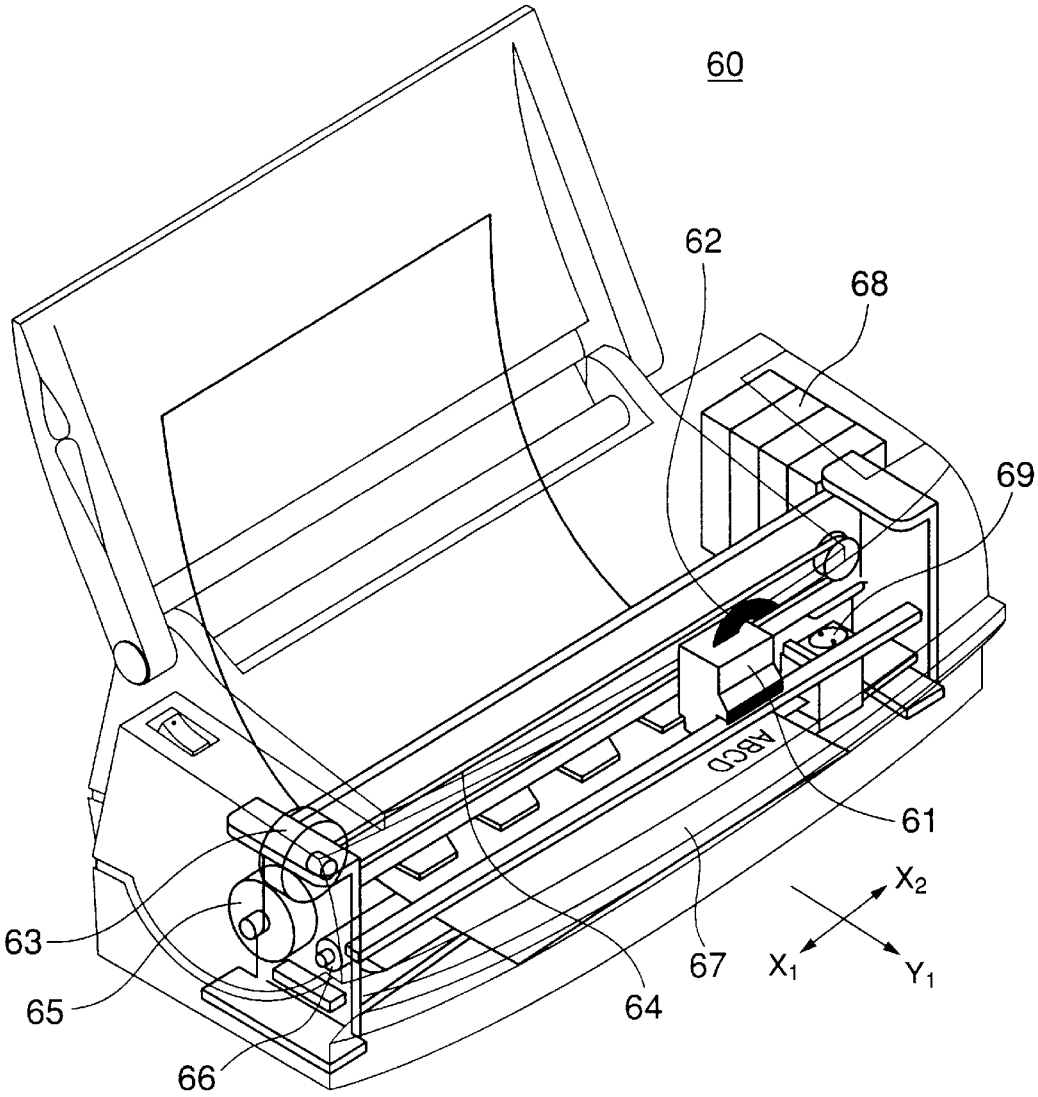
FIG. 3 is a perspective view showing an embodiment of an ink jet printer according to the present invention.

FIG. 3 is a perspective view showing an embodiment of an ink jet printer according to the present invention. This embodiment of the ink jet printer uses an embodiment of an ink jet head according to the present invention.

When a space motor 63 of an ink jet printer 60 shown in FIG. 3 is driven, an ink jet head 61 driven to move in directions X1 and X2 via a belt 64. When a feed motor 65 is driven a feed roller 66 is rotated to transport a paper 67 in a direction Y1. Printing is carried out on the entire surface of the paper 67 which is transported in this manner. A tube 62 for supplying ink is provided in the ink jet head 61, so that the ink within an ink tank 68 can constantly be supplied. A backup unit 69 is provided to prevent clogging of nozzles when no printing is carried out. The backup unit 69 performs operations such as covering a nozzle portion of the ink jet head 61, periodically cleaning the nozzle surface during the printing, and sucking the ink in order to prevent clogging of the nozzles.

Figure 4:
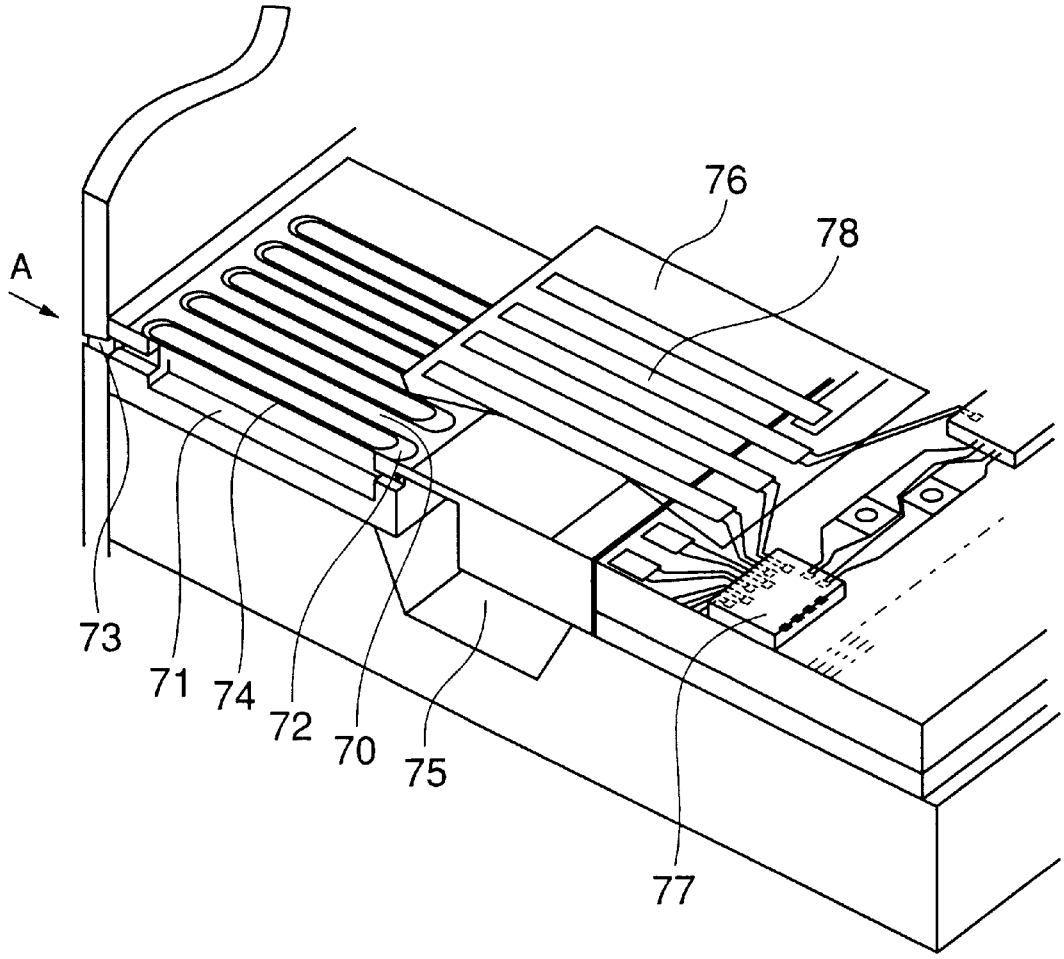
FIG. 4 is a perspective view showing an embodiment of an ink jet head according to the present invention.

As shown in FIG. 4, the ink jet head 61 has a plurality of piezoelectric elements 72 provided on a vibration plate 70, in correspondence with pressure chambers 71. An individual electrode 74 is provided on top of each piezoelectric element 72. A nozzle 73 is provided on a tip end of each pressure chamber 71, via an ink passage for inducing the ink from the pressure chamber 71 to the nozzle 73 and for arranging the ink flow in one direction. When a voltage is applied across the individual electrode 74 and the vibration plate 70 and the piezoelectric element 72 is charged, the vibration plate 70 is bent so as to reduce the volume of the pressure chamber 71. As a result, the ink within the pressure chamber 71 is jetted from the nozzle 73 as the volume of the pressure chamber 71 is reduced, thereby producing the ink jet of the ink drop. When the charge of the piezoelectric element 72 is discharged, the vibration plate 70 returns to its original flat non-bent state. As the vibration plate 70 returns to its original flat non-bent state, the ink within a common ink passage 75 is supplied to the pressure chamber 71.

In addition, a tip end of each of wiring patterns 78 of a flexible printed circuit board 76 is connected to the corresponding one of the individual electrodes 74 of the piezoelectric elements 72. On the other hand, another tip end of each of the wiring patterns 78 is connected to a driving signal generating circuit 77.

FIGS. 5A through 5E, 6A through 6D, and 7A and 7B respectively are perspective views for explaining production processes of this embodiment of the ink jet head, wherein the piezoelectric elements having the bimorph structure are formed by use of the thin film technique.

Figure 5A:
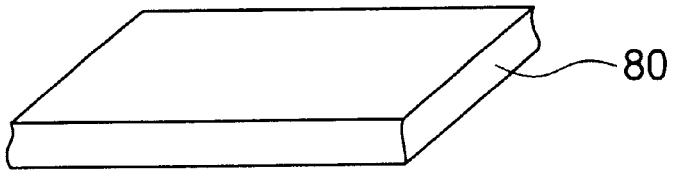
FIGS. 5A through 5E respectively are perspective views for explaining production processes of the ink jet head.
Figure 5B:
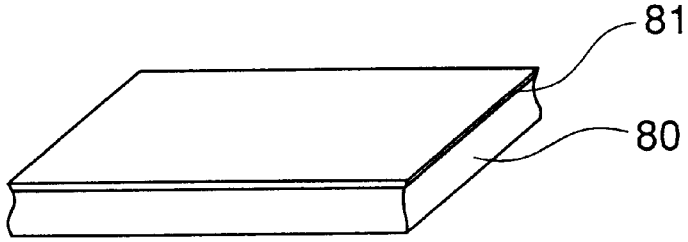
Figure 5C:
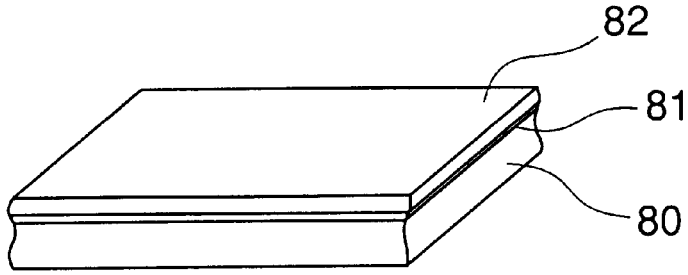

FIG. 5A shows a target substrate 80. The target substrate 80 is selected depending on a lattice constant of the piezoelectric elements which are to be formed. In this embodiment, the target substrate 80 is made of a MgO single crystal substrate having a thickness of 0.3 mm. Next, an electrode layer 81 which becomes the individual electrodes is formed on the target substrate 80 by sputtering, as shown in FIG. 5B. In this embodiment, the electrode layer 81 is made of Pt. Then, as shown in FIG. 5C, a piezoelectric element (PZT) 82 is formed on the electrode layer 81 by sputtering.

Figure 5D:
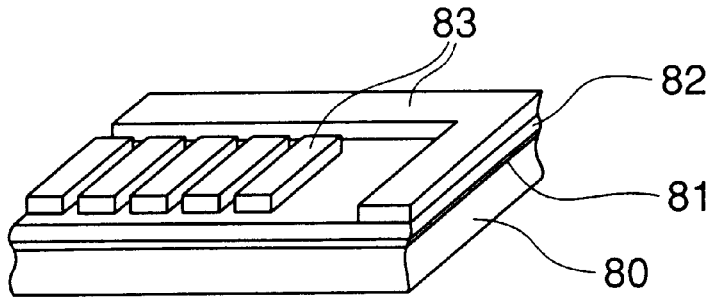

As shown in FIG. 5D, milling patterns 83 are formed on the piezoelectric element 82 by a first dry film resist. The milling patterns 83 are used to divide the piezoelectric element 82 and the electrode layer 81 into piezoelectric elements and the electrode layer 81 into piezoelectric elements and individual electrodes respectively corresponding to pressure chambers. The first dry film resist is formed on parts where the electrode layer 81 and the piezoelectric element 82 are to remain. In this embodiment, an alkaline type resist F1215 manufactured by Tokyo Ohka Kogyo Co., Ltd. of Japan is used as the first dry film resist and is formed to a thickness of 15 $\mu$m, for example. More particularly, the first dry film resist is laminated at a line pressure of 2.5 kgf/cm, a rate of 1 m/s, and a temperature of 115° C. Next, the above described structure is exposed to ultraviolet (UV) light at 120 mJ using a glass mask, preheated at 60° C. for 10 minutes, and then cooled to room temperature. The structure is then developed using a 1 wt % $Na_2CO_3$ solution. As a result, the milling patterns 83 shown in FIG. 5D are formed.

Figure 5E:
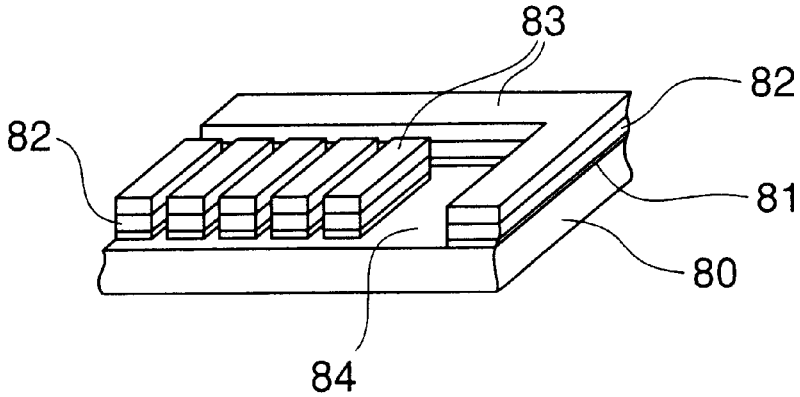

Next, the target substrate 80 is secured on a Cu holder using grease with a good thermal conductivity, and the milling is carried out at an irradiation angle of 15° and 700 V using only Ar gas. Accordingly, a milling part 84 for independently forming the electrode layer 81 and the piezoelectric element 82 is formed as shown in FIG. 5E. In this embodiment, the above described milling resulted in a satisfactory vertical cut with a taper angle of 85° or greater in a depth direction.

Figure 6A:
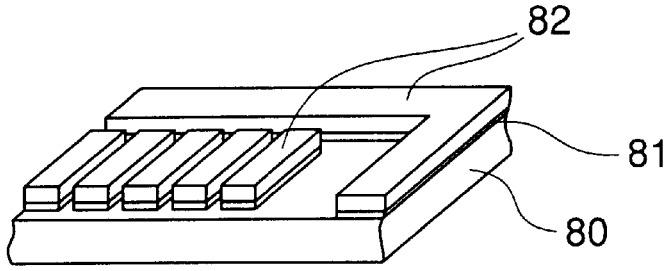
FIGS. 6A through 6D respectively are perspective views for explaining the production processes of the ink jet head.
Figure 6B:
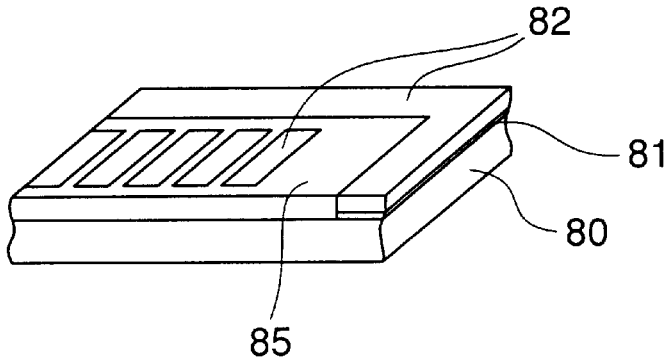
Figure 6C:
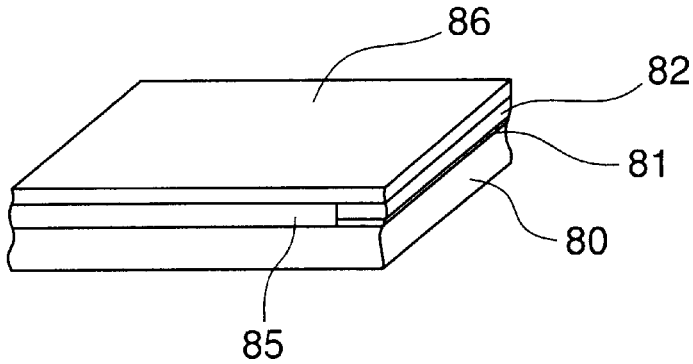

The milling patterns 83 are then removed as shown in FIG. 6A, and a planarizing layer 85 is formed on the milling part 84 as shown in FIG. 6B. Because the piezoelectric element 82 is extremely thin, an insulator breakdown may occur between the electrode layer 81 which forms the individual electrodes and the vibration plate which forms the common electrode. The planarizing layer 85 is provided to prevent such an insulator breakdown, so that the ink jet head can perform a stable operation and achieve a high durability. The provision of this planarizing layer 85 also enables a vibration plate 86 shown in FIG. 6C to be formed in a flat shape. The vibration plate 86 needs to be formed flat, because the bending energy of the piezoelectric element 82 would otherwise be absorbed by the non-planarized portion of the vibration plate 86 and deteriorate the driving efficiency of the ink jet head. As shown in FIG. 6C, the vibration plate 86 is formed by sputtering on the planarizing layer 85 and the piezoelectric element 82 which are formed as described above, to thereby form actuator parts indicated by the hatching. In this embodiment, the vibration plate 86 is made of NiCr or Cr.

Figure 6D:
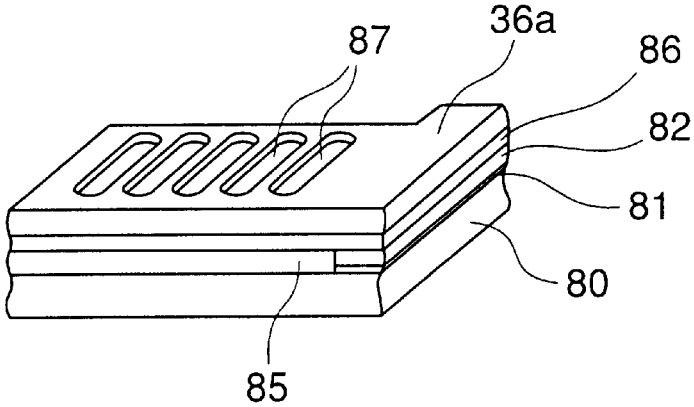

Pressure chambers 87 are formed after forming the actuator parts. A main body 36 which forms the pressure chambers 87, is made up of two parts 36*a* and 36*b* which will be described later. First, as shown in FIG. 6D, the pressure chambers 87 are formed on the vibration plate 86 in correspondence with each of divided portions of the electrode layer 81 and divided portions of the piezoelectric element 82. The main body part 36*a* which forms the pressure chambers 87 is formed using a second dry film resist. In this embodiment, a PR-100 series resist manufactured by Tokyo Ohka Kogyo Co., Ltd. of Japan is used as the second dry film resist. More particularly, the second dry film resist is laminated at a line thickness of 2.5 kgf/cm, a rate of 1 m/s, and a temperature of 35° C. Next, the above described structure is positioned using alignment marks used during the milling of the electrode layer 81 and the piezoelectric element 82, exposed to UV light at 180 mJ, preheated at 60° C. for 10 minutes, and then cooled to room temperature. The structure is then developed and rinsed respectively using a C-3 solution and a F-5 solution which are manufactured by Tokyo Ohka Kogyo Co., Ltd. of Japan. As a result, the main body part 36*a* having the structure shown in FIG. 6D is formed.

Figure 7A:
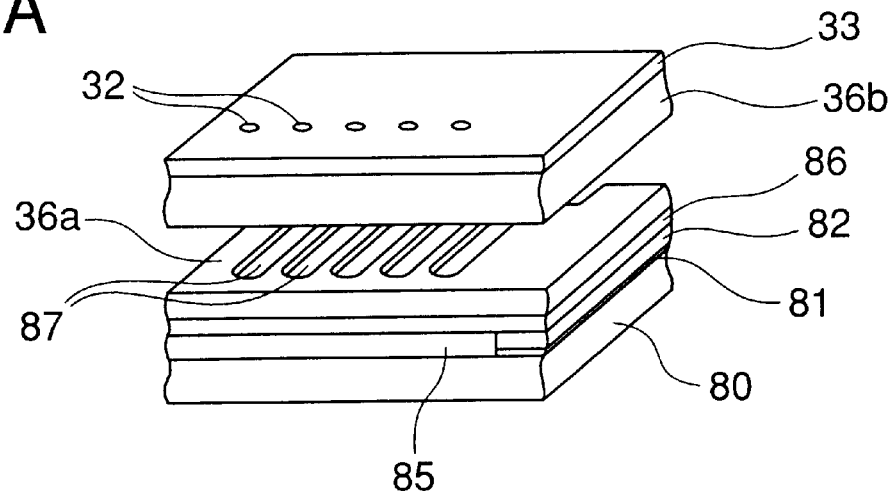
FIGS. 7A and 7B respectively are perspective views for explaining the production processes of the ink jet head.

On the other hand, the other main body part 36*b* and a nozzle plate 33 shown in FIG. 7A are formed by another process. The main body part 36*b* is formed by performing the laminating, exposing and developing steps with respect to the second dry film resist a predetermined number of times, similarly as described above. More particularly, straight nozzles 32 having a diameter of 20 $\mu$m are formed in the nozzle plate 33 having a thickness of 20 $\mu$m. Then, the ink passage for inducing the ink from the pressure chambers 87 to the nozzles 32 and arranging the ink flow in one direction, is formed with a diameter of 60 $\mu$m to a depth of 60 $\mu$m. Each pressure chamber 87 is formed above the ink passage, with a width of 100 $\mu$m, a depth of 1700 $\mu$m, and a depth of 60 $\mu$m. First, the second dry film resist is laminated on the nozzle plate 33, and the exposure is made by positioning the pattern of the ink passage to the alignment marks which are formed in advance on the nozzle plate 33. In addition, the second dry film resist is further laminated, and the patterns of the pressure chambers 87 are positioned similarly and exposed. Thereafter, the obtained structure is naturally cooled at room temperature for 10 minutes, thermally hardened at a temperature of 60° C. for 10 minutes, and developed by a solvent so as to remove the portions where the ink passage and the pressure chambers 87 are formed.

The main body parts 36*a* and 36*b* which are formed in the above described manner are disposed to confront each other as shown in FIG. 7A, and positioned by use of the respective alignment marks formed thereon. After the main body parts 36*a* and 36*b* are pressed with a force of 15 kgf/cm$^2$ and preheated at a temperature of 80° C. for 1 hour, the main body parts 36*a* and 36*b* are then actually bonded at a temperature of 150° C. for 14 hours and naturally cooled. As a result, the main body 36 which integrally comprises the main body parts 36*a* and 36*b* which are accurately bonded at a boundary surface 36' is formed as shown in FIG. 7B.

Figure 7B:
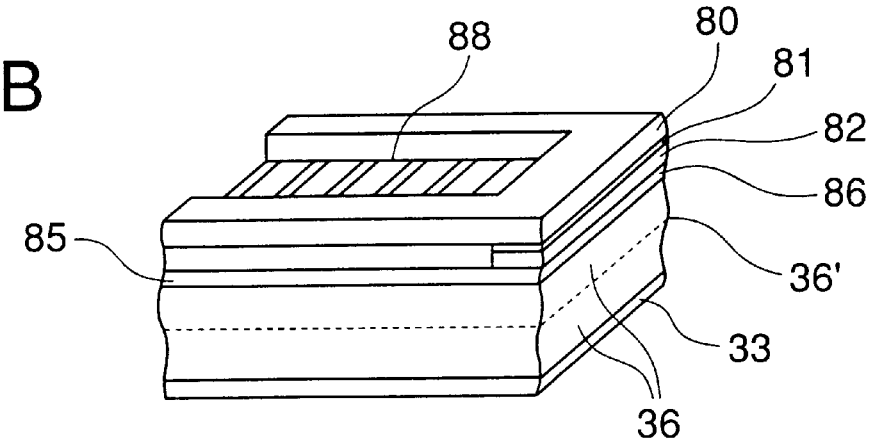

FIG. 7B shows the main body 36 in a state upside-down from the state shown in FIG. 7A. By carrying out the processes described above, the actuator parts of the ink jet head are firmly fixed on the target substrate 80 and cannot be deformed. Hence, as shown in FIG. 7B, it is necessary to remove at least a portion of the target substrate 80 corresponding to the divided portions of the electrode layer 81 and the piezoelectric element 82. More particularly, an opening 88 is formed in the target substrate 80 by etching. By removing the portion of the target substrate 80 by forming the opening 88, without removing the target substrate 80 in its entirety, the remaining target substrate 80 can act as a protecting part for protecting the actuator parts, so as to prevent the thin actuator parts from being damaged. In addition, this structure also improves the production reliability of the ink jet head.

As described above, the electrode layer 81, the piezoelectric element 82 and the vibration plate 86 are successively formed on the target substrate 80 by the thin film technique, so as to form the actuator parts. For this reason, it is possible to form thin actuator parts having the same shape as the independent electrodes, with a high precision and a high reliability.

The vibration plate 86 is formed after the piezoelectric element 82, because the lattice constant of the target substrate 80 is not reflected on the upper layers and the lattice matching deteriorates if the upper layers are thick. For this reason, this embodiment successively forms the relatively thin electrode layer 81, piezoelectric element 82 and vibration plate 86 on the target substrate 80 in this sequence. Further, the vibration plate 86 is directly stacked on the piezoelectric element 82 after the piezoelectric element 82 is formed. In other words, the vibration plate 86 is not simply stacked on the piezoelectric element 82, but a thin film of the vibration plate material is formed by the thin film technique, such as sputtering, directly on a smooth thin film of the piezoelectric element material, such as PZT, which is formed similarly by the thin film technique.

Of course, the structure and production processes of the ink jet head are not limited to those described above, and various other structures and processes may be employed, regardless of ink shooting types of ink jet heads, such as edge shooting or side shooting. The thin film technique used is not limited to the sputtering, and other techniques such as CVD may be employed. Furthermore, it is also possible to modify the production processes, so that for example, the target substrate is removed after forming the electrode layer, the piezoelectric element and the vibration plate, and the electrode layer and the piezoelectric layer are thereafter divided into the respective divided parts.

The normal block-shaped piezoelectric element or, the piezoelectric element which is formed by the thick film technique such as the screen printing, have a low density in that a large number of grain boundaries and air bubbles are generated due to the sintering. On the other hand, when the piezoelectric element is formed by the thin film technique such as the sputtering, it is possible to form a piezoelectric element having crystal properties close to a single crystal, by controlling the material, crystal orientation, temperature and the like of the substrate. The piezoelectric element which is formed by the thin film technique has a smooth surface, and the internal crystal properties of the piezoelectric element is very good.

Generally, one might think that the mechanical strength of the piezoelectric element which is formed by the thin film technique would be poor. However, by successively forming the thin films as described above using the continuous sputtering, for example, so that the thin films are carefully formed and the thin film surfaces are carefully processed, it is possible to considerably improve the mechanical strength of the piezoelectric element. According to the experiments conducted by the present inventors, it was confirmed that the piezoelectric elements of the ink jet head which is produced as described above in conjunction with FIGS. 5A through 7B have a sufficiently high durability with respect to the bimorph operations.

The reason for the improved mechanical strength of the piezoelectric elements of the ink jet head according to the present invention, may be explained by the following theory which applies to the mechanical strength of glass, for example. In other words, glass, which is a brittle solid, breaks in most cases with respect to a tensile strength. When the theoretical strength of glass is calculated from Young's coefficient and the surface tension, a value on the order of approximately $1\times10^{10}$ Pa is obtained. However, the strength of the practical glass is only on the order of 1/100 of the above value, and is approximately $5\times10^{7}$ Pa for a glass plate. The large difference between the theoretical strength and the practical strength of glass is due to the fact that fine scratches exist on the glass surface and the tension concentrates on the tip ends of the scratches. If the clean surface of the glass immediately after its formation is immediately covered and protected by a protection layer, so that the generation of scratches is prevented, it is possible to obtain a strength on the order of $3\times10^{9}$ Pa to $4\times10^{9}$ Pa.

From the theory described above, it may be regarded that the practical strength of the piezoelectric element can be improved considerably by forming the piezoelectric element by the thin film technique and forming the vibration plate directly on the piezoelectric element. Hence, it is possible to obtain a piezoelectric element which is suited for use in the ink jet head of the present invention and the ink jet printer of the present invention. For example, the practical strength of the sintered piezoelectric element is only on the order of $6\times10^{7}$ Pa, but the practical strength can be considerably improved to $5\times10^{8}$ Pa or greater by forming the piezoelectric element by the sputtering, for example.

Figure 8A:
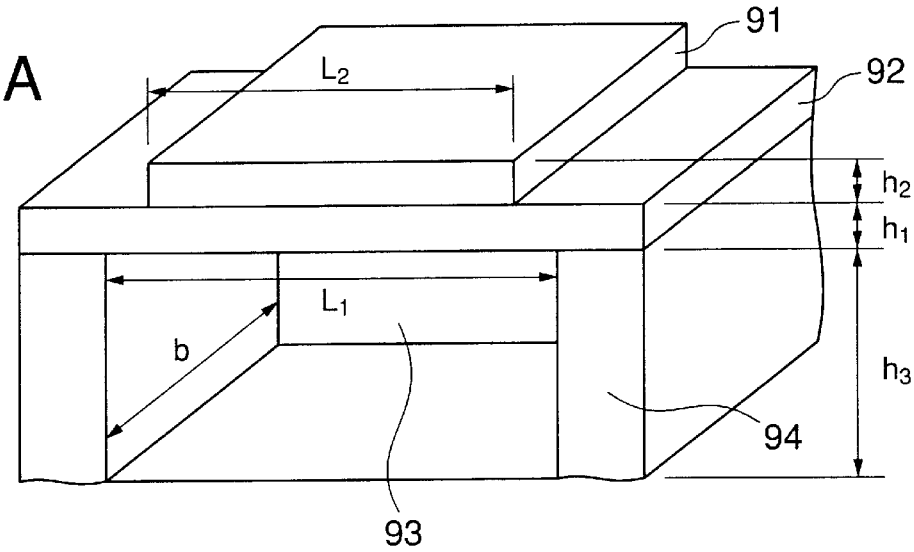
FIGS. 8A and 8B respectively are diagrams for explaining the operation of the ink jet head.
Figure 8B:
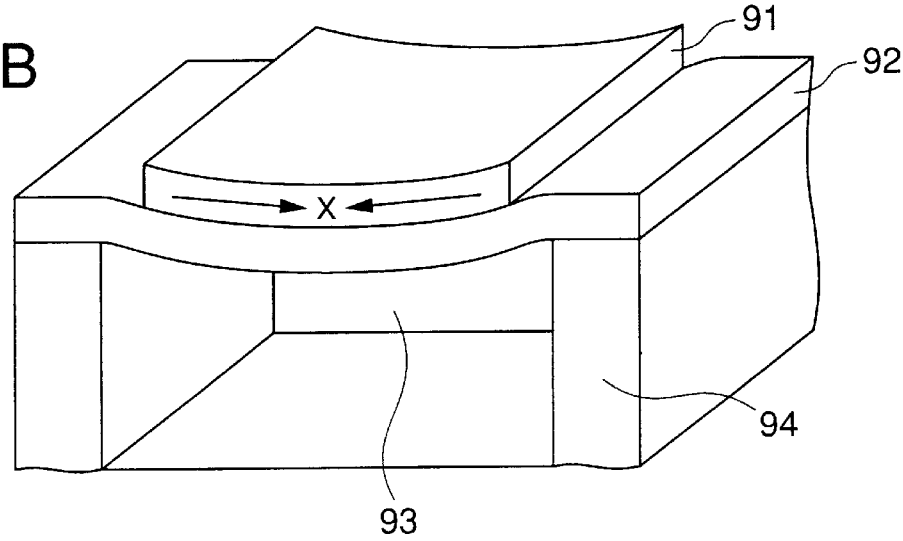

FIGS. 8A and 8B respectively are diagrams for explaining the operation of this embodiment of the ink jet head. FIGS. 8A and 8B respectively show the pressure chamber viewed in a direction A in FIG. 4. FIG. 8A shows the dimensions of the various parts, and FIG. 8B shows the contracted state of the piezoelectric element.

As shown in FIG. 8A, the size of a pressure chamber 93, which corresponds to the pressure chambers 71 and 87 described above, is determined by walls 94 and a vibration plate 92 which defines the pressure chamber 93. The vibration plate 92 corresponds to the vibration plates 70 and 86 described above. For the sake of convenience, it is assumed that the pressure chamber 93 has a width L1, a height h3, and a depth b. On the other hand, it is assumed that the vibration plate 92 has a thickness h1, and that a width and a depth of the driving part are the same as those of the pressure chamber 93, that is, L1 and b, respectively. Further, it is assumed that a piezoelectric element 91, which corresponds to the piezoelectric elements 72 and 82 described above, has a thickness h2, a width L2, and a depth which can cover the depth b of the pressure chamber 93. Hence, the piezoelectric element 91 has a depth of substantially b.

When a voltage is applied on the piezoelectric element 91, the piezoelectric element 91 contracts in directions X, as shown in FIG. 8B. On the other hand, the vibration plate 92 is bonded to the piezoelectric element 91, and acts so as to prevent contraction of the piezoelectric element 91. As a result, the vibration plate 92 bends in a direction towards the pressure chamber 93, as shown in FIG. 8B. When the vibration plate 92 bends, a volume displacement occurs in the pressure chamber 93, the ink is jetted from the nozzle by this volume displacement. The size of the ink drop jetted from the nozzle is approximately equal to this volume displacement. A volume displacement V0 [$m^3$] is defined as the amount of change in the volume within the pressure chamber 93 when a voltage V [V] is applied to the piezoelectric element 91 having a Young's modulus E [Pa] and a piezoelectric constant d31 [m/V] in the direction X which is perpendicular to the electric field.

FIG. 9 is a diagram for explaining performances of various ink jet heads. In FIG. 9, L1 denotes the width of the pressure chamber, b denotes the depth of the pressure chamber, h1 denotes the thickness of the vibration plate, h2 denotes the thickness of the piezoelectric element, L2 denotes the width of the piezoelectric element, E denotes the Young's modulus (or vertical elastic modulus), V0 denotes the volume displacement of the pressure chamber, and V denotes the voltage applied to the piezoelectric element. In addition, d31 denotes the piezoelectric constant, which is equal to $-200\times10^{-12}$ m/V for examples EX1 through EX3, and is equal to $-100\times10^{-12}$ m/V for comparison examples CX1 and CX2 and embodiments EMB1 through EMB6. Furthermore, a term $V0/(L2^2b)$ relates to mechanical distortion, and is referred to as the mechanical distortion index. A term $EV0/(L2^2b)$ relates to stress, and is referred to as the stress index. A term V/h2 denotes the electric field intensity.

The examples EX1 through EX3 correspond to prior art ink jet heads. The comparison examples CX1 and CX2 are conceivable examples of the ink jet heads which are not prior art, and are shown for comparison purposes. The embodiments EMB1 through EMB6 are embodiments of the ink jet head according to the present invention.

In the example EX1, the piezoelectric element which is formed in the plate shape (plate-shaped piezoelectric element) is cut into square parts to form the ink jet head with the bimorph structure.

In the example EX2, the plate-shaped piezoelectric element is cut into rectangular parts to form the ink jet head with the bimorph structure. The width of the rectangular parts in the direction in which the pressure chambers are arranged, is narrowed compared to the example EX1.

In the example EX3, the ink jet head is formed by forming the piezoelectric elements on the vibration plate by the screen printing.

In the comparison examples CX1 and CX2 and the embodiments EMB1 through EMB6, the ink jet head is formed by forming the piezoelectric elements and the vibration plate by the sputtering.

In FIG. 9, the values for the comparison examples CX1 and CX2 and the embodiment EMB1 are obtained for the ink jet heads which are formed to the same size as the ink jet head of the example EX3, but by use of the sputtering as the thin film technique. For example, a Japanese Laid-Open Patent Application No.10-209517 teaches a method of forming the piezoelectric element by the thin film technique. In the comparison example CX1, the ink jet head is driven with the same electric field intensity as the example EX3.

As may be seen from FIG. 9, the volume displacement V0 for the comparison example CX1 is lower than that of the example EX3. Hence, even if the ink jet head having the same size as the example EX3 is formed by the thin film technique and driven in the same manner, the ink jet quantity decreases, thereby making it impossible to obtain an ink jet head having a satisfactory printing efficiency according to the comparison example CX1. The values for the comparison example CX2 are obtained for the ink jet head which is driven at the same stress index $EV\mathbf{0}/(L\mathbf{2}^2b)$ as the example EX3. In this case, the volume displacement V0 for the comparison example CX2 is also lower than that of the example EX3. Hence, as in the case of the comparison example CX1, the ink jet quantity decreases, thereby making it impossible to obtain an ink jet head having a satisfactory printing efficiency according to the comparison example CX2.

On the other hand, the piezoelectric element which is driven in the embodiment EMB1 is selected and produced so that the mechanical distortion index $V\mathbf{0}/(L\mathbf{2}^2b)$ is $1117\times10^{-6}$, the stress index $EV\mathbf{0}/(L\mathbf{2}^2b)$ is $100.5\times10^6$, and the electric field intensity $V/h\mathbf{2}$ is $15.2\times10^6$. As may be seen from FIG. 9, the volume displacement V0 for the embodiment EMB1 is approximately four times that of the example EX3. Therefore, by satisfying at least one of the following relationships in the embodiment EMB1, it is possible to realize a satisfactory printing efficiency, even when the piezoelectric element used is formed by the thin film technique. Preferably, all of the following relationships are simultaneously satisfied.

$$V\mathbf{0}/(L\mathbf{2}^2b)>550\times10^{-6}$$

$$EV\mathbf{0}/(L\mathbf{2}^2b)>30\times10^6$$

$$V/h\mathbf{2}>3.0\times10^6$$

The values for the embodiments EMB2 through EMB6 are obtained for the ink jet heads having the dimensions shown in FIG. 9 and which are formed by the thin film technique. The ink jet heads of the embodiments EMB2 through EMB4 are even more suited for high performance printers as compared to those of the comparison examples CX1 and CX2 and the embodiment EMB1.

According to the embodiments EMB2 through EMB4, the thickness of the piezoelectric element is 3 $\mu$m which is less than the thickness of 10 $\mu$m which can be mass produced by the thin film technique. Furthermore, the nozzle pitch (dpi) of the embodiments EMB2 through EMB4 are approximately 2.5 times those of the comparison examples CX1 and CX2 and the embodiment EMB1. By increasing the nozzle pitch, that is, reducing the pitch with which the nozzles are provided, by approximately 2.5 times as compared to the comparison examples CX1 and CX2 and the embodiment EMB1, it becomes possible to produce 2.5 times more ink jet heads at one time on the substrate of the same size, thereby enabling improved productivity and reduced cost. In addition, by reducing the thickness h2 of the piezoelectric element by a factor of one digit as compared to the comparison examples CX1 and CX2 and the embodiment EMB1, it becomes possible to reduce the production time required to form the piezoelectric element by the sputtering by a factor of one digit, which means that the number of ink jet heads produced can be increased by a factor of one digit. Furthermore, because of the reduced size of the pressure chambers of the embodiments EMB2 through EMB4, it is possible to drive the ink jet head at a higher speed than the comparison examples CX1 and CX2, that is, the ink drop can be jetted at shorter periods. As a result, the relative capacity of the nozzle (the amount of jetted ink volume for unit pressure chamber area) can be improved compared to the comparison examples CX1 and CX2.

In FIG. 9, the larger the relative capacity of the nozzle, the larger the relative capacity value. In addition, in FIG. 9, "–" under evaluation means that the performance of the ink jet head cannot be evaluated because it is very poor, "X" means that the performance of the ink jet head is poor, "Δ" means that the performance of the ink jet head is good and satisfactory, and "○" means that the performance of the ink jet head is extremely good.

Therefore, according to the embodiments EMB2 through EMB4, it is possible to obtain a sufficiently high ink jet capability, even though the productivity of the ink jet head is improved. Further, according to the embodiment EMB4, it is possible to obtain an ink jet quantity comparable to that of the example EX3, even though the sizes of the pressure chambers and the piezoelectric elements are reduced.

The values for the embodiments EMB5 and EMB6 shown in FIG. 9 are obtained for the ink jet heads having twice the nozzle pitch as that of the embodiments EMB2 through EMB4. By increasing the nozzle pitch, that is, reducing the pitch with which the nozzles are provided, by approximately 5 times as compared to the comparison examples CX1 and CX2, it becomes possible to produce 5 times more ink jet heads at one time on the substrate of the same size, thereby enabling improved productivity and reduced cost. Moreover, because of the further reduced pressure chambers, the ink drops jetted by the embodiments EMB5 and EMB6 is smaller than those jetted by the embodiments EMB2 through EMB4. However, since the ink jet heads of the embodiments EMB5 and EMB6 can be driven at an even higher speed, it is still possible to realize an ink jet performance which is greatly improved over the examples EX1 through EX3.

In addition, according to the embodiments EMB5 and EMB6, the volume displacements V0 of the pressure chambers are respectively $1.5\times10^{-15}$ m$^3$ and $3.5\times10^{-15}$ m$^3$ which are smaller by a factor of one digit compared to those of the comparison examples CX1 and CX2 and the other embodiments EMB1 through EMB4. However, as described above, when the ink uses a dye density of approximately 3%, the visible limit of an isolated dot recognizable by the human eyes is approximately 2 pl. Hence, the ink drop sizes of approximately 1.5 pl and 3.5 pl which are respectively obtained by the volume displacements V0 of $1.5\times10^{-15}$ m$^3$ and $3.5\times10^{-15}$ m$^3$ are still within the tolerable range of obtaining a high-quality image without the use of a hypochromic ink. In other words, it is possible to obtain a sufficiently high printing performance while enabling printing of a high-quality image. Furthermore, it is possible to produce the ink jet printer at a low cost because it is unnecessary to use the hypochromic ink. That is, the heads and the related parts which were conventionally provided with respect to five or six colors can be reduced to the heads and the related parts which are provided with respect to three colors, because the hypochromic ink is not used. As a result, the ink jet printer of the present invention can be produced at a low cost compared to the conventional ink jet printer, and the performance of the ink jet printer of the present invention can be made high compared to that of the conventional ink jet printer.

In the embodiments EMB3 and EMB5, the piezoelectric elements used have a maximum stress of 150 MPa. On the other hand, the piezoelectric elements used in the embodiments EMB4 and EMB6 have a maximum stress of 350 MPa.

Therefore, by satisfying at least one of the following relationships in the embodiments EMB4 through EMB6, it is possible to realize satisfactory productivity and ink jet performance, even when the piezoelectric element used is formed by the thin film technique. Preferably, the following relationships are simultaneously satisfied.

$$V0/(L2^2b)>2000\times10^{-6}$$

$$EV0/(L2^2b)>180\times10^{6}$$

$$V/h2>8.3\times10^{6}$$

Therefore, as described above in conjunction with the embodiments EMB3 through EMB6, in a desirable arrangement, the total thickness of the thin film piezoelectric element and the vibration plate is 10 μm or less, where the vibration plate forms the top wall surface of the pressure chamber, and the thin film piezoelectric element generates the piezoelectric effect in the in-plane direction of one surface of the vibration plate. In addition, the ink jet quantity is 1 pl or greater, and the nozzles of the multi-nozzle ink jet head are arranged at a pitch of approximately 150 dots/inch or greater.

Further, the present invention is not limited to these embodiments, but various variations and modifications may be made without departing from the scope of the present invention.

What is claimed is:

1. An ink jet head comprising:

a pressure chamber;

a vibration plate; and a piezoelectric element, provided on the vibration plate, causing a volume displacement of the pressure chamber, said piezoelectric element having a thickness of 20 μm or less, said pressure chamber and said piezoelectric element satisfying a relation $$VO/(L2^2b)>550\times10^{-6}$$

where VO denotes a volume displacement of the pressure chamber when the piezoelectric element is driven, L2 denotes a width of the piezoelectric element, and b denotes a depth of the pressure chamber.

2. The ink jet head as claimed in claim 1, wherein the width L2 of the piezoelectric element is greater than or equal to 22 μm and less than or equal to 300 μm.

3. The ink jet head as claimed in claim 1, wherein the vibration plate has a size described by $$1.5\times10^{-6}\ m\leqq h1+h2\leqq30\times10^{-6}\ m$$

$$28\times10^{-6}\ m\leqq L1\leqq330\times10^{-6}\ m$$

where h1 denotes a thickness of the vibration plate, h2 denotes the thickness of the piezoelectric element, and L1 denotes a width of the pressure chamber.

4. The ink jet head of claim 1, further comprising:

a nozzle connected to said pressure chamber;

said piezoelectric element generating a piezoelectric effect in an in-plane direction of one surface of said vibration plate;

said piezoelectric element and said vibration plate having a total thickness of 10 μm or less; and said nozzle having an ink jet quantity of 1 pl or greater when said piezoelectric element is driven, and being arranged at a pitch of 150 dots/inch or greater.

5. An ink jet head comprising:

a pressure chamber;

a vibration plate; and a piezoelectric element, provided on the vibration plate, causing a volume displacement of the pressure chamber, said piezoelectric element having a thickness of 20 μm or less, said pressure chamber and said piezoelectric element satisfying a relation $$EVO/(L2^2b)>30\times10^{6}\ Pa$$

where E denotes a Young's modulus of the piezoelectric element, VO denotes a volume displacement of the pressure chamber when the piezoelectric element is driven, L2 denotes a width of the piezoelectric element, and b denotes a depth of the pressure chamber.

6. The ink jet head as claimed in claim 5, wherein the width L2 of the piezoelectric element is greater than or equal to 22 μm and less than or equal to 300 μm.

7. The ink jet head as claimed in claim 5, wherein the vibration plate has a size described by $$1.5\times10^{-6}\ m\leqq h1+h2\leqq30\times10^{-6}\ m$$

$$28\times10^{-6}\ m\leqq L1\leqq330\times10^{-6}\ m$$

wherein h1 denotes a thickness of the vibration plate, h2 denotes the thickness of the piezoelectric element, and L1 denotes a width of the pressure chamber.

8. The ink jet head of claim 5, further comprising:

a nozzle connected to said pressure chamber;

said piezoelectric element generating a piezoelectric effect in an in-plane direction of one surface of said vibration plate, said piezoelectric element and said vibration plate having a total thickness of 10 μm or less, and said nozzle having an ink jet quantity of 1 pl or greater when said piezoelectric element is driven, and being arranged at a pitch of 150 dots/inch or greater.

9. An ink jet head comprising:

a pressure chamber;

a vibration plate; and a piezoelectric element, provided on the vibration plate, causing a volume displacement of the pressure chamber;

said piezoelectric element having a thickness of 20 μm or less, said pressure chamber and a voltage applied to the piezoelectric element satisfying a relation $$V/h2>3.0\times10^{6}\ V/m$$

where V denotes the voltage applied to the piezoelectric element, and h2 denotes a thickness of the piezoelectric element.

10. The ink jet head as claimed in claim 9, wherein a width L2 of the piezoelectric element is greater than or equal to 22 μm and less than or equal to 300 μm.

11. The ink jet head as claimed in claim 9, wherein the vibration plate has a size described by $$1.5\times10^{-6}\ m\leqq h1+h2\leqq30\times10^{6}\ m$$

$$28\times10^{-6}\ m\leqq L1\leqq330\times10^{-6}\ m$$

where h1 denotes a thickness of the vibration plate, and L1 denotes a width of the pressure chamber.

12. An ink jet printer comprising:

an ink jet head including a pressure chamber, a vibration plate, and a piezoelectric element which is provided on the vibration plate and causes a volume displacement of the pressure chamber, said piezoelectric element having a thickness of 20 μm or less, said pressure chamber and said piezoelectric element satisfying a relation $$VO/(L2^{2}b)>550\times10^{-6}$$

where VO denotes a volume displacement of the pressure chamber when the piezoelectric element is driven, L2 denotes a width of the piezoelectric element, and b denotes a depth of the pressure chamber.

13. An ink jet printer comprising:

an ink jet head including a pressure chamber, a vibration plate, and a piezoelectric element which is provided on the vibration plate and causes a volume displacement of the pressure chamber, said piezoelectric element having a thickness of 20 μm or less, said pressure chamber and said piezoelectric element satisfying a relation $$EVO/(L2^{2}b)>30\times10^{6}\ Pa$$

where E denotes a Young's modulus of the piezoelectric element, VO denotes a volume displacement of the pressure chamber when the piezoelectric element is driven, L2 denotes a width of the piezoelectric element, and b denotes a depth of the pressure chamber.

14. An ink jet printer comprising:

an ink jet head including a pressure chamber, a vibration plate, and a piezoelectric element which is provided on the vibration plate and causes a volume displacement of the pressure chamber, said piezoelectric element having a thickness of 20 μm or less, said pressure chamber and a voltage applied to the piezoelectric element satisfying a relation $$V/h2>3.0\times10^{6}\ V/m$$

where V denotes the voltage applied to the piezoelectric element. and h2 denotes a thickness of the piezoelectric element.

* * * * *